United States Patent [19]

MacDougall

[11] Patent Number: 4,673,166

[45] Date of Patent: Jun. 16, 1987

[54] SECURITY FENCE

[76] Inventor: Ellis C. MacDougall, 42 Woodwind Ct., P.O. Box 12521, Columbia, S.C. 29211

[21] Appl. No.: 826,020

[22] Filed: Feb. 4, 1986

[51] Int. Cl.[4] ..... E04H 17/00

[52] U.S. Cl. ..... 256/11; 256/1

[58] Field of Search ..... 256/11, 1

[56] References Cited

FOREIGN PATENT DOCUMENTS

| | | | |
|---|---|---|---|
| 186 | 1/1926 | Australia | 256/11 |
| 244919 | 2/1926 | Italy | 256/11 |
| 48309 | 7/1909 | Switzerland | 256/11 |
| 1264309 | 2/1972 | United Kingdom | 256/1 |

*Primary Examiner*—Andrew V. Kundrat

*Attorney, Agent, or Firm*—Dennison, Meserole, Pollack & Scheiner

[57] ABSTRACT

A security fence including multiple laterally spaced fence posts extending upwardly from ground anchored lower end portions at an arcuate inclination of approximately 50° to 65°. The posts are interconnected by horizontal rails and mount wire mesh or the like. The fence terminates in an upper terminal end portion vertically above the ground and laterally offset from the lower portion of the fence to preclude direct physical access to the upper terminal end portion.

12 Claims, 3 Drawing Figures

SECURITY FENCE

BACKGROUND OF THE INVENTION

The present invention is concerned with fences, and more particularly security fences as might be found around confinement areas, prisons, and the like. Such fences also are frequently provided to exclude persons from areas for both the protection of the person, as at construction sites, and for protection of the site itself, as at industrial sites, secret installations, and even homes or residential areas.

The conventional fence, when a question of security is involved, will normally consist of mulltiple vertical posts projecting perpendicularly upward from a stable support base, normally the ground, with the posts mounting paneling or partitions which in the most common form will consist of a continuous length of wire mesh.

Such basic fences, while providing a barrier against any casual desire to move from one side of the fence to the other, do provide ready handholds and footholds and can be easily scaled by a determined person or persons. In an attempt to enhance the effectiveness of such fences, it has been proposed that angled extensions, with wire strands or the like, be mounted to the upper ends of the posts to extend upwardly and inwardly toward one side of the fence. Such extensions are normally relatively short with the outer or free edges thereof generally easily accessed by a person having both a handhold and a foothold on the vertical fence itself. As such, the portion of the barrier which provides the maximum effectiveness, when considering a person of reasonable agility, is at the extreme top of the fence.

SUMMARY OF THE INVENTION

The fence of the present invention is specifically constructed to provide a positive barrier, against a person attempting to climb the fence, throughout the full height of the fence.

In conjunction with the structure of the fence having enhanced barrier forming capabilities, it is also of particular significance that the construction be economically feasible both in materials and installation procedures. In regard thereto, the fence of the invention includes ground-anchored upright posts which define the sole supports for the fence and which in turn mount the barrier paneling, normally in the nature of wire mesh. As such, the materials differ little from those of a conventional fence.

The aspect of the invention considered particularly unique is the formation of the fence posts, in the installed fence, to specifically angle inwardly toward the side of the fence to which a person is to be confined. This inward angling of the fence posts, and hence the entire fence, is effected by utilizing fence posts anchored to project vertically upwardly from the ground or stable base and, at a predetermined height, to arcuately arch upwardly and laterally from the vertically positioned and anchored lower end portion.

The angle of inclination is such as to effectively preclude, due to the "overhang" nature of the fence throughout at least the major portion of the height thereof, the establishment of a foothold. In other words, one attempting to scale the fence would be limited to only the use of the hands for the full effective height of the fence above the point at which a person can reach by standing on the ground. As one tries to scale the fence, the higher one goes, the further one's feet move from the ground and the lower portion of the fence. A person attempting to establish both a handhold and a foothold would be positioned substantially on his back, and thus normally incapable of maintaining any sort of foothold.

It is contemplated that the inclined portion of the fence extend at an angle of between 50°–65° to the horizontal, with the optimum angle being 52°. This inclination will follow an arcuate path which is continuously laterally offset from the vertical and defines a generally 60° arc. The radius of the arc extends approximately 13'-8" from a center of rotation approximately 1'-5" below the vertical height at which the arc commences. Such a 60° arc has been found to afford a desirable combination of usable area adjacent the fence and a high degree of effectiveness, in combination with maximum strength, in precluding any attempt to scale the fence.

Based on the above, the height of the fence will be approximately 11 to 15 feet, depending on the height of the vertical lower protion, with the inclined portion extending for a height of at least 11 feet. Similarly, the lateral reach of the fence, to the upper terminal end portion thereof, will preferably be approximately 8 feet. So dimensioned, the upper terminal end portion of the fence will be of a height above the support base, for example the ground, sufficient to preclude direct simultaneous physical access to both this upper end portion and the ground. At the same time, the lateral extent of the upper end portion will be such as to simultaneously preclude direct physical access to the terminal end portion and any portion of the fence below the continously inclined major portion thereof.

As desired, the upper end of the fence, at the terminal end portion, can be finished by an inwardly and downwardly inclined section formed either by reversely turning the upper ends of the posts themselves, or by affixing downwardly and inwardly incline extensions to the post ends. In each case, appropriate paneling, wiring, or the like will extend along the turned end sections.

DESCRIPTION OF PREFERRED EMBODIMENTS

Figure 1:
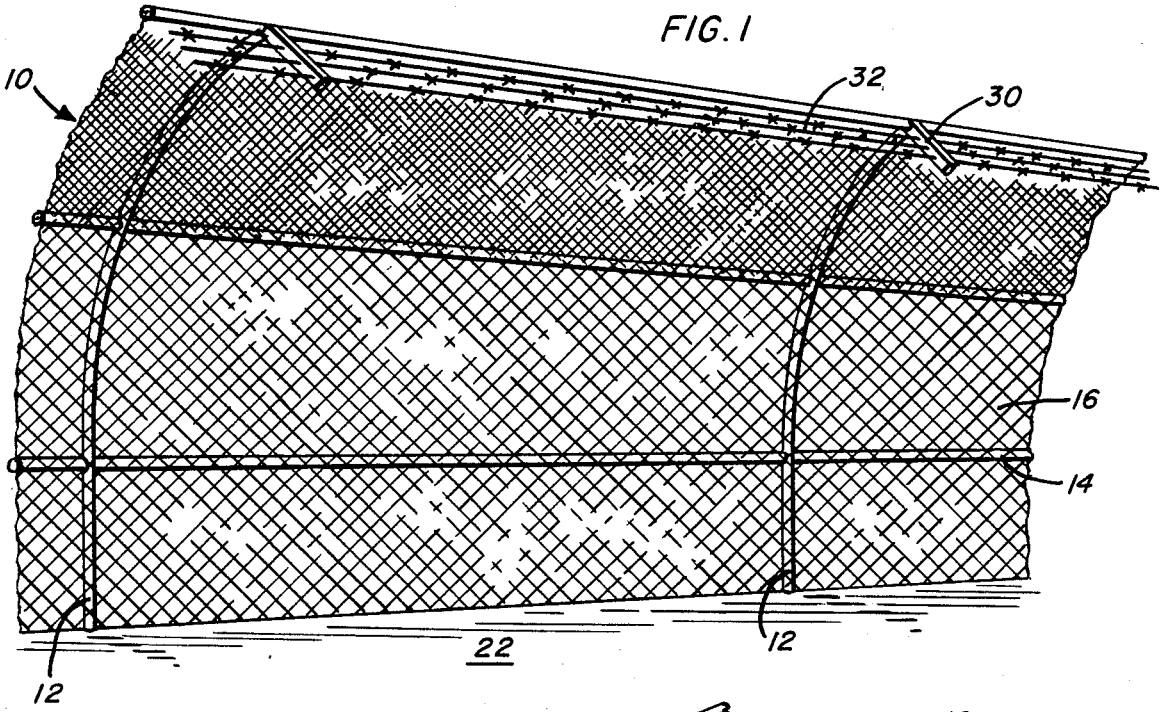
FIG. 1 is a partial perspective view of a portion of a fence constructed in accord with the present invention.

Referring now more specifically to the drawings, a section of a typical fence 10, constructed in accord with the present invention, has been illustrated, in perspective, in FIG. 1.

The fence 10 includes multiple laterally spaced upright fence posts 12, stabilizing cross rails 14 and fence paneling 16, normally in the nature of wire mesh. As in a conventional fence, the fence posts will be positioned to define a line or barrier dividing an area into opposed or first and second sides to preclude passage from one side to the other.

Figure 2:
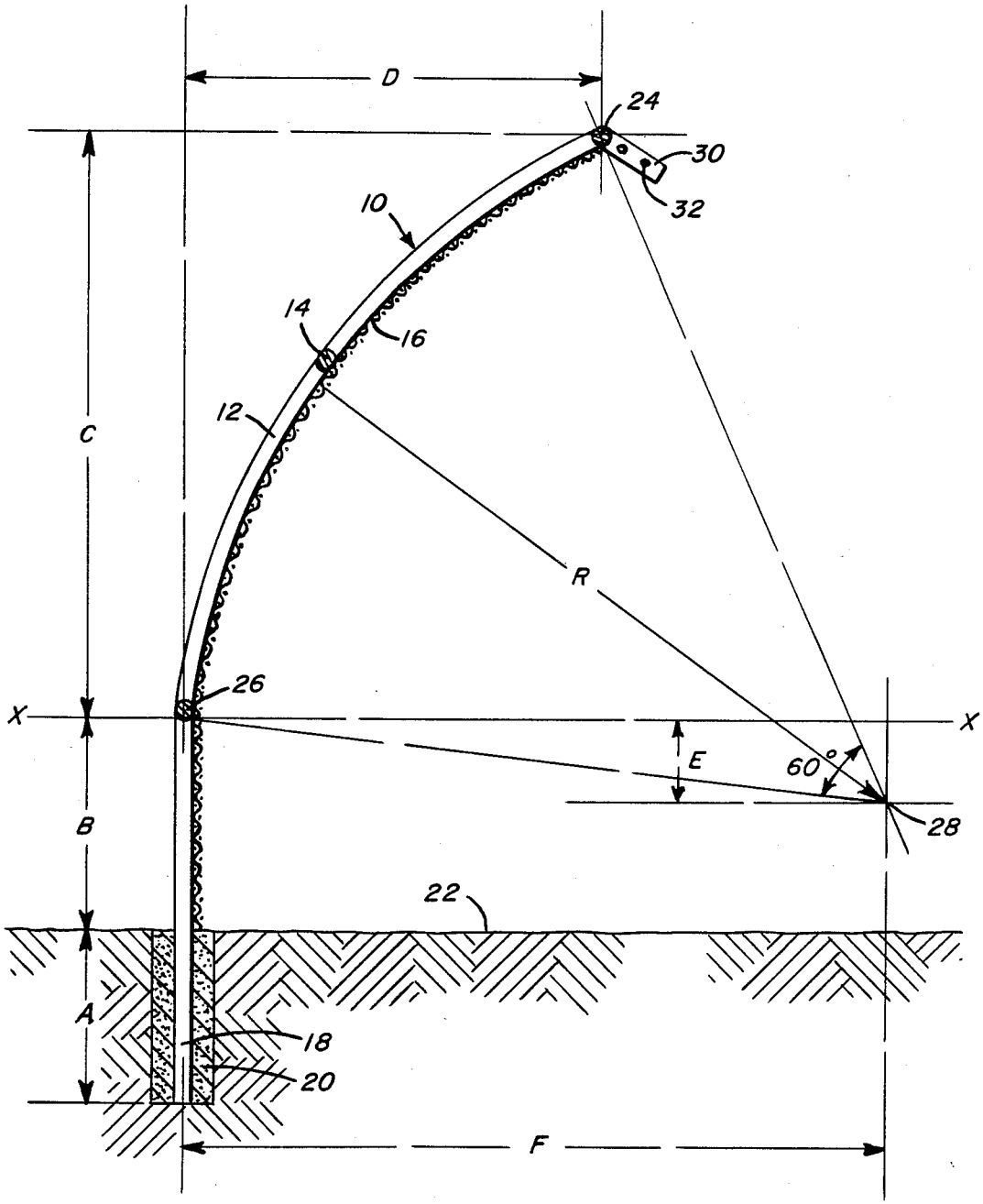
FIG. 2 is an enlarged vertical cross-sectional schematic view through the fence of FIG. 1.

It is a primary intention of the invention to provide a superior barrier while, at the same time, utilizing basic fence construction techniques and materials. Pursuant thereto, and noting in particular FIG. 2, the fence posts 12 of the fence 10 of the present invention are specifically configured to incline toward one side of the fence and into or over the area to which persons are to be confined or restricted, whether this be within a prison facility or the like or outside of a restricted area.

The lower end portion 18 of each fence post 12 will normally be anchored within an appropriate concrete foundation or the like 20 provided within a stable base 22, normally the ground. The embedded depth "A" of the anchored lower end 18, while normally approximately 3 feet, will vary as necessary with ground and climatic conditions. Each post 12, for a major portion of the exposed height thereof, will extend along a continuously arcing path, terminating in a point of maximum height at the upper terminal end portion 24. While the continuously arcing curvature of the posts 12 may commence immediately at ground level, it is preferred that the inclination of the posts being at a predetermined point 26 above ground level, the post being vertical or perpendicular to the ground between the point 26 and the ground. The provision of such a vertical section, normally of a height "B" on the order of approximately 4 feet, is considered desirable under particular circumstances to avoid an unnecessary restriction of the area immediately adjacent the base of the fence, possibly for the purpose of providing patrols or the like as in a security situation.

As will be appreciated, the fence posts 12 all incline to the same or a common side of the fence 10 with the major inclined portion of the posts, and hence the fence, terminating at the upper terminal end portions 24. These upper terminal end portions 24 are to be positioned at a height above the base or ground 22 sufficient to preclude direct simultaneous physical access to both the upper terminal end portions and the ground. As such, it is contemplated that, in a typical installation, the upper terminal end portions be approximately 15 feet above ground level and at a height "C" approximately 11 feet above the point 26 at which the inclination is initiated. Similarly, the upper terminal end portions are preferably laterally removed or positioned from the vertical portion of the posts, or point 26 of initiation of the inclination, a distance "D" approximately 8 feet. In defining the inclination of the posts 12, each post will follow a 60° arc defined from a point of rotation 28 on a radius "R" 13'-8" from point 26. Point 28 is at a vertical distance "E" of 1'-5" below the height of point 26 or the point at which the inclination is initiated, and at a perpendicular distance "F" of 13' 7⅛" from the lower vertical section of the post 12. Formed in this manner, the lower point 26, at which the inclination is initiated, the upper terminal end portion 24, and the center of rotation 28 of each post will define an equilateral triangle with three included 60° angles. The horizontal at the height of point 26 has been indicated as line x—x in FIG. 2. The actual inclination to the horizontal x—x, defined by an imaginary line between lower point 26 and upper end portion 24 will be an optimum 52°. This angle to the horizontal may fall within a range of 50° to 65°.

With the posts so configured, a fence defined thereby will be substantially impossible to scale, by a person with normal agility, when moving from the side toward which the inclination is directed. Basically, the height of the fence, which precludes direct access to the upper terminal end portion thereof, and the inclination, which precludes any possibility of obtaining a foothold as one attempts to traverse the fence, requires reliance, by one attempting to scale the fence, solely on the hands, and the strength of the arms. There is no possibility of scaling the fence in the manner in which a conventional vertical fence can be scaled. Further, the task of attempting to negotiate the fence by reliance solely on handholds can be made increasingly difficult by the use of a smaller or more tightly woven mesh toward the upper portion of the fence 10.

When formed as above described, the use of 3½" diameter steel pipe is contemplated. For purposes of additional strength and stability, the laterally spaced fence posts 12 will be braced and interconnected by rails 14 coplanar therewith and welded or otherwise mechanically connected, at the opposed ends thereof, to adjacent ones of the posts 12. Such rails will additionally help to support and anchor the paneling or mesh 16 which, as noted in FIGS. 1 and 2, will be applied to the posts 12 and rails 14 to the side toward which the fence inclines, thus also precluding any possibility of reliance on the rails by one attempting to scale the fence.

As an additional security feature, the upper terminal end portions 24 of the posts can each be provided with a downwardly inclined rigid section or extension 30 secured in any appropriate manner, for example by the use of brackets, welding, or the like. These extensions 30 will in turn mount, transversely thereacross, strands of barbed wire 32 or other forms of meshing or the like.

Figure 3:
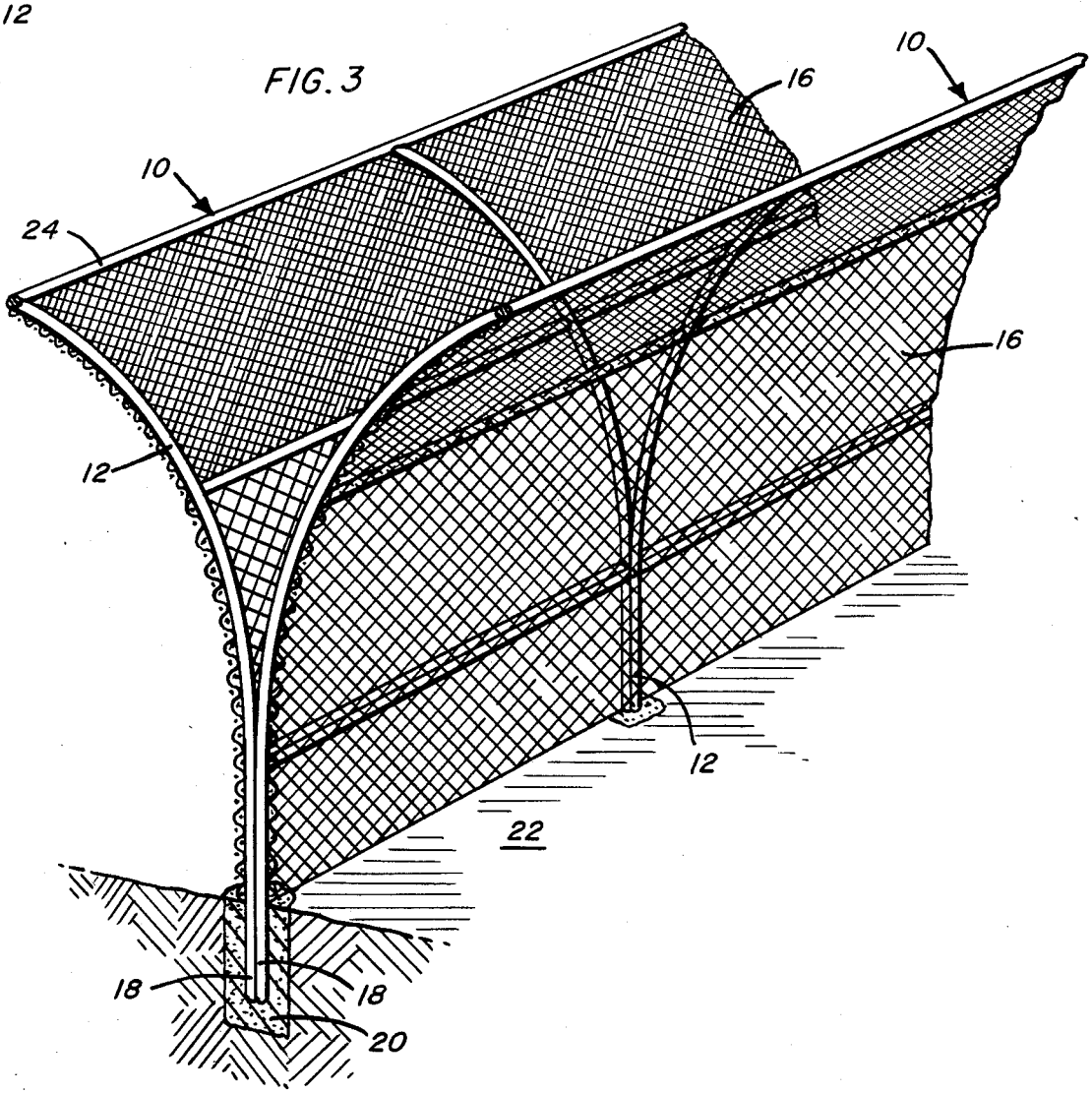
FIG. 3 is a partial perspective of a variation of the invention wherein a dual fence construction is utilized, precluding access from either side of the construction to the other.

FIG. 3 illustrates a variation wherein dual fences 10 are used as a means for precluding movement in both directions.

Basically, corresponding oppositely directed posts 12 are provided in pairs and anchored in common footings 20. The posts 12 of each pair incline upward and laterally outward relative to each other from the embedded and anchored adjacent lower end portions 18 to the laterally spaced upper terminal end portions 24. Each set of similarly directed inclined posts 12 will be stabilized by transverse rails 14, and appropriate wire mesh 16 or the like will be secured to the posts 12 and rails 14 of each set to the side toward which the posts 12 incline, thereby providing the fence paneling.

The height of the combination fence of FIG. 3 will follow the general parameters suggested with regard to the previously described fence 10. Basically, it is contemplated that the combination fence, at the upper terminal end portions, be approximately 11 to 15 feet high with the lateral offset to each side, from the anchored lower end portions, being 8 or more feet.

It is intended that the fence of the invention provide a situation wherein a person attempting to scale the fence cannot simultaneously physically access the upper portion of the fence and any point whereat an appropriate foothold can be obtained, thus requiring reliance solely on whatever handholds might be available. Moreover, the provision of handholds, particularly toward the upper portion of the fence, can be limited by the use of small wire meshing, that is fence wire meshing defining openings of limited size.

As suggested in FIG. 3, the fence assembly of the invention can be arranged in oppositely directed pairs to preclude movement from either side of the fence to the other. Preferably, the dual oppositely directed assemblies will be mounted in a common foundation.

The foregoing is considered illustrative of the principles of the invention. It is to be understood that changes and modifications, may occur to those skilled in the art without departing from the nature and principles of the invention.

What is claimed is:

1. A security fence mounted to a stable base and defining a barrier to preclude passage of a person attempting to climb the fence from a first side thereof to a second side thereof as a confinement or exclusive means, said security fence comprising multiple laterally spaced fence posts, said fence posts being positioned to define a line dividing an area into first and second sides, each said fence post comprising a lower end portion anchored to the stable base with the remainder of the post supported therefrom and terminating in an upper terminal end portion, each said post including a vertical section extending upwardly from said stable base, and a generally inclined portion, comprising the major portion of the vertical height of the post, extending in a smooth unbroken configuration from said vertical section and terminating at said upper terminal end portion, said inclined portion being continuously generally inclined at approximately a 50° to 65° angle to the horizontal to a common side and to a point wherein said upper terminal end portion is positioned at a height above said base sufficient to preclude direct simultaneous physical access by a climber to said upper terminal end portion and said base, and at a position laterally removed from said lower end portion sufficient to preclude direct simultaneous physical access by a climber to said upper terminal end portion and the vertical section of the corresponding post below said continuously inclined major portion, fence paneling fixed to and between said posts and substantially coextensive with the height thereof, and additional security means extending downwardly from the upper terminal end portions of said posts and terminating in upwardly spaced relation above the vertical sections of the posts.

2. The security fence of claim 1 wherein said additional security means comprises paneling terminating in inwardly spaced relation to the posts to the common side to which the posts incline.

3. The security fence of claim 1 wherein said fence paneling comprises a wire mesh with defined openings of a predetermined size, said additional security means comprising a wire mesh with defined openings of a size substantially smaller than said predetermined size of the fence paneling mesh, said mesh of the additional security means being fixed to and between said posts, said fence paneling mesh terminating below said upper terminal end portions, and said security means mesh extending between said fence paneling mesh and said upper terminal end portions.

4. The security fence of claim 1 wherein said major inclined portion of each post is of a generally arcuate configuration.

5. A security fence mounted to a stable base and defining a barrier to preclude passage of a person attempting to climb the fence from a first side thereof as a confinement or exclusive means, said security fence comprising multiple laterally spaced fence posts, said fence posts being positioned to define a line dividing an area into first and second sides, each said fence post comprising a lower end portion anchored to the stable base with the remainder of the post supported therefrom and terminating in an upper terminal end portion, each said post, for the major portion of the vertical height thereof terminating at said upper terminal end portion, being continuously inclined at approximately a 50° to 65° angle to the horizontal to a common side and to a point wherein said upper terminal end portion is positioned at a height above said base sufficient to preclude direct simultaneous physical access by a climber to said upper terminal end portion and said base, and at a position laterally removed from said lower end portion sufficient to preclude direct simultaneous physical access by a climber to said upper terminal end portion and the corresponding post below said continuously inclined major portion of the corresponding post, and fence paneling fixed to and between said posts and coextensive with the height thereof, an extension fixed to the upper terminal end portion of each post and projecting inwardly and downwardly to the common side to which the posts incline, and paneling mounted on and extending between the extensions.

6. The security fence of claim 5 wherein each said post includes a minor portion of the height thereof extending perpendicular to the base between the anchored lower end portion and the major inclined portion.

7. The security fence of claim 5 wherein said major inclined portion of each post is of a generally arcuate configuration.

8. The security fence of claim 7 wherein the arcuate configuration of each post defines an arc of approximately 60° from a center of rotation at a radial distance of approximately 13'-8".

9. The security fence of claim 5 wherein said upper terminal end portion is at least approximately eleven feet above the anchored lower end portion.

10. The security fence of claim 5 including rails engaged with and extending between adjacent posts, said rails being coplanar with said posts.

11. A security fence construction comprising generally coextensive first and second sets of aligned fence posts, the posts of each set being continuously inclined to a common side with the posts of the first and second sets being inclined to opposite sides from adjacent lower end portions to laterally spaced upper end portions, said posts being arranged in pairs of one post from each set, and fence paneling fixed to each set of fence posts coextensive therewith.

12. The security fence construction of claim 11 wherein the inclination of each fence post follows an arcuate configuration.

* * * * *